US006925991B1

(12) United States Patent
Phelps

(10) Patent No.: US 6,925,991 B1
(45) Date of Patent: Aug. 9, 2005

(54) FUEL SUPPLY SYSTEM

(76) Inventor: Harold E. Phelps, 40514 Newport Ct., Plymouth, MI (US) 48170

( * ) Notice: Subject to any disclaimer, the term of this patent is extended or adjusted under 35 U.S.C. 154(b) by 0 days.

(21) Appl. No.: 10/771,571

(22) Filed: Feb. 4, 2004

(51) Int. Cl.[7] ..... F02M 37/04
(52) U.S. Cl. ..... 123/505; 123/495
(58) Field of Search ..... 123/505, 495, 123/463, 502; 417/500, 495, 242

(56) References Cited

U.S. PATENT DOCUMENTS 2,949,903 A * 8/1960 Dietrich ..... 123/453
3,990,413 A * 11/1976 Pischinger ..... 123/275
6,347,614 B1 * 2/2002 Evers et al. ..... 123/446

* cited by examiner

*Primary Examiner*—Marmoud Gimie
(74) *Attorney, Agent, or Firm*—Gifford, Krass, Groh, Sprinkle, Anderson & Citkowski, P.C.

(57) ABSTRACT

A fuel supply system for reciprocating engines in which predetermined amounts of fuel are injected into the air fuel supply of the engine in timed relation to the reciprocating engine with the amounts of fuel varying in response to speed and load on said engine by varying the stroke of a reciprocating fuel pump in response to the position of a throttle valve.

12 Claims, 2 Drawing Sheets

FUEL SUPPLY SYSTEM

FIELD OF THE INVENTION

This invention relates to fuel supply system for small internal combustion engines and in particular to the injection of fuel mechanically.

BACKGROUND OF THE INVENTION

The operation of small internal combustion engines which are used with a variety of tools and equipment, such as lawn and garden equipment, generators, out-board motors and the like require that the carburetor or fuel system be simple and capable of controlling operation in all possible positions of the engine. At the same time, the engine must be controlled so that it operates effectively and minimizes the exhaust of unburned fuel and oil to the atmosphere.

Present day small engines typically use conventional carburetors to control fuel delivery to the combustion chamber of the engine. Carburetors operate inefficiently in that unburned fuel is exhausted to the atmosphere resulting in pollution. Such systems, however, have been refined over many years and perform dependably and are of relatively low cost. The injection of fuel is more advantageous because it permits more accurate control of the amount and timing of the delivery of the fuel to the combustion chamber of the engine so that reduced emissions, fuel savings and increased power result. Typically, however, injection of fuel is controlled electronically. This is impractical for small engines because the control module alone could exceed the cost of the small engine.

SUMMARY OF THE INVENTION

It is the object of the invention to provide a mechanical fuel control or management system that can be used with two or four-cycle engines in which a predetermined quantity of fuel is injected for each intake stroke of the engine.

Another object of the invention is to provide a fuel supply system having a pump with a variable volume intake and a positive displacement discharge.

Still another object of the invention is to provide a fuel supply system in which the fuel is in direct proportion to the engine speed and load and only the required amount of fuel is supplied to the engine.

It is also the object of the invention to provide a mechanically operated fuel control system which is simple and economical to produce and operates efficiently to deliver only the fuel required to obtain speed and power requirements without excessive emission of fuel.

The objects of the invention are achieved by a fuel system for an engine in which fuel is delivered to the air intake or mixing passage of a four cycle engine or the combustion chamber of a two cycle engine by a pump in which the output is controlled by modifying the stroke of the pump in response to movement of the throttle valve for the air control of the engine which reflects the speed and load of the engine.

The pump is reciprocated and the effective stroke of the output of the piston fuel pump is controlled by a cam which is programmed and moved by the governor or manually in response to the engine speed and load over a range reflecting low to high speeds to accomplish short strokes and low volume of fuel at low speed and longer strokes and higher fuel volume at high engine speeds.

The fuel pump is operated by hydraulic pressure supplied by an actuator or fuel pump operated by the cam that moves the valves on a four-cycle engine. This is a fixed movement whereas the pump control is managed by the position of a cam determining the stroke of hydraulic a fuel pump having a variable fuel output. This cam can be shaped or programmed to accommodate different conditions of engine operation.

DETAILED DESCRIPTION

Figure 1:
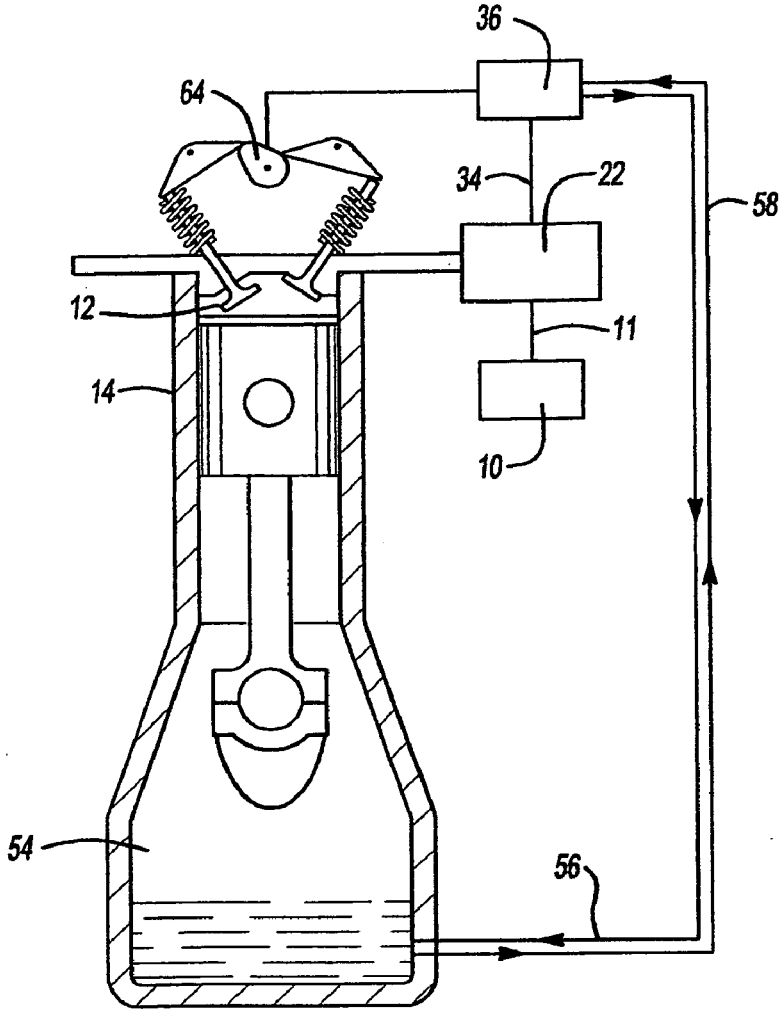
FIG. 1 is a cross sectional diagrammatic view showing a single cylinder four-cycle engine incorporating the fuel injector and injector pump in association with its valve cam shaft and air intake.
Figure 4:
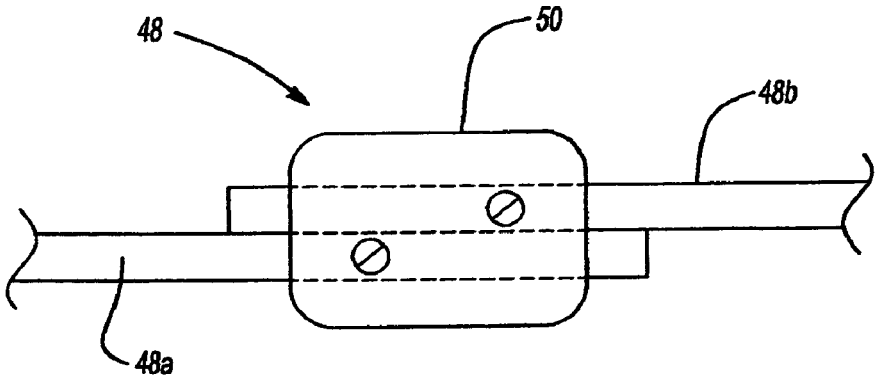
FIG. 4 is an enlarged view of a linkage element used in the fuel control system.

A fuel supply system of the present invention is used to control delivery of fuel from a tank or a reservoir 10 and line 11 to the combustion chamber 12 of a four-cycle engine 14 as shown in FIG. 1.

The injector system incorporates a fuel injector 16 having its outlet end positioned in the fuel and air mixing passage 17 of Venturi member 18 receiving air through an inlet 18*a* and delivering a fuel air mixture through outlet 18*b* to the combustion chamber 12 and a fuel pump 20 for supplying fuel from the tank 10 to the injector 16. The injector 16, Venturi member 18 and pump 20 can be incorporated in the same body member 22 seen in FIG. 1 and attached to the engine as a unit.

The pump 20 is controlled by an outlet check valve 26 and an intake inlet check valve 28 are provided in the fuel passage to the injector 16. The injector 16 receives fuel from the hydraulically actuated fuel pump 20 which has a reciprocating piston 30 and rod 30*a* urged in a fuel intake direction by a spring 32 and in the fuel outlet or injection direction by pulses of hydraulic pressure received through a line 34 from a hydraulic actuator 36 indicated in FIG. 1 and in greater detail in FIG. 3.

The piston 30 of fuel pump 20 reciprocates in a cylinder 37 and has a fuel chamber 38 formed in part by rod 30*a* with a variable stroke. Piston 30 is urged in a fuel intake direction by spring 32 into contact with a programmable cam 40 pivoted about an axis 41. The fuel pump piston 30 reciprocates in the opposite or output direction due to the hydraulic fluid pressure pulses received from the hydraulic actuator 36 to an upper position to compress the spring 32.

On the intake stroke of piston 30, outlet check valve 26 is closed and inlet check valve 28 is opened to admit fuel into the chamber 38 of pump 20. During the discharge stroke, outlet check valve 26 is open and inlet check valve 28 is closed so that movement of the piston discharges the fuel through fuel injector nozzle 16 into the mixing passage 17 of Venturi member 18. The amount of fuel required for each combustion cycle of the engine is small so that a piston rod 30*a* having a rod portion 0.125 inches in diameter could have a stroke to the order of 0.020" at low speeds and 0.100" at high speeds.

Figure 2:
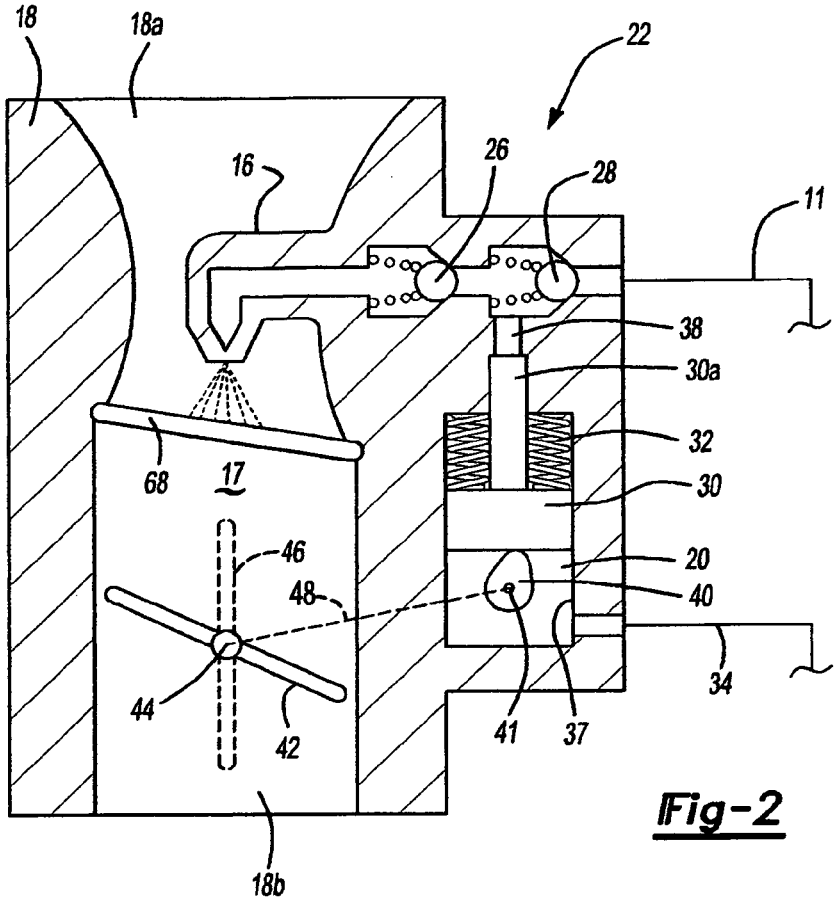
FIG. 2 is an enlarged view of the air intake, injector and injector pump showing the idle speed position.

The maximum fuel intake stroke of pump piston 30 is determined by programmable cam 40 which is pivoted about an axis indicated at 41 and moves in response to movement of a butterfly or throttle valve 42 about its shaft 44 between idle position illustrated in full line in FIG. 2 and a high speed position illustrated in dotted line at 46. The position of the butterfly or throttle valve 42 may be controlled by an engine governor or manually. The cam 40 is connected by linkage 48 between the shaft 44 of the throttle valve 42 and axis 41 of cam 40. When using such a linkage 48 it is desirable to use a vibration dampening mechanism in the form of a mass of resilient elastomeric material 50 joining the separate parts 48*a* and 48*b* of link 48. This serves to dampen and smooth minor movements of the throttle valve 42 and the operation of the linkage 48 during engine operation. The connection between the butterfly valve 42 and stroke limiting cam 40 can also be a common shaft or gears.

The position of the cam 40 determines the stroke and output of the fuel pump 20 and is varied in response to speed and load of the engine determined by the position of throttle valve 42 which in turn is determined by an engine governor or manual control.

Figure 3:
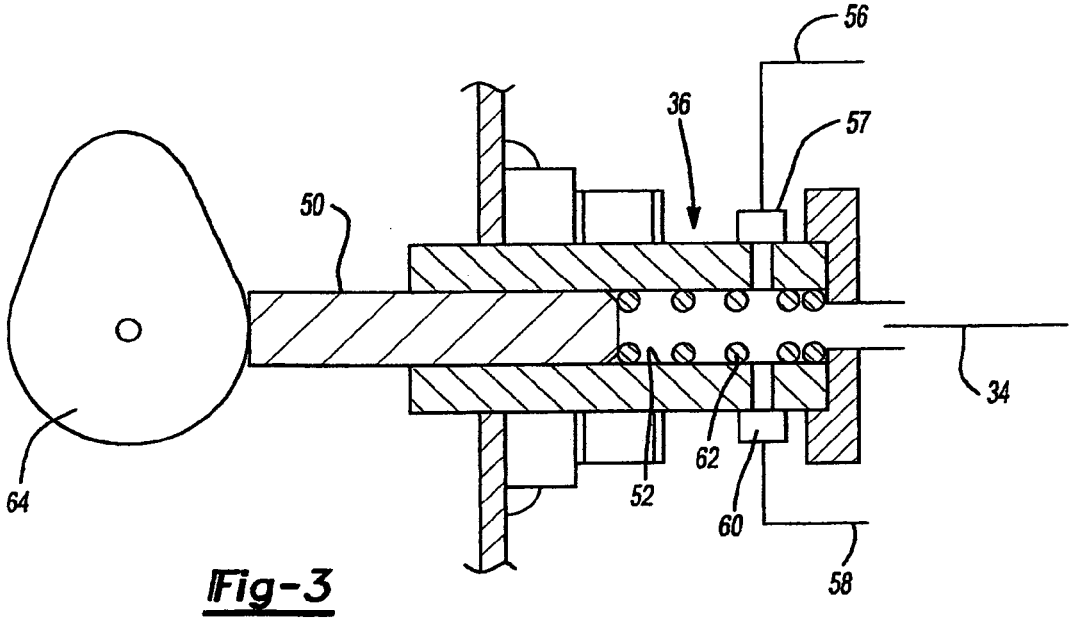
FIG. 3 is a view of a fuel pump actuator in association with a valve cam.

As seen in FIG. 3, the hydraulic actuator 36 for driving the fuel pump 20 is in the form of a reciprocating piston 50 moving in a cylinder 52. The cylinder 52 is in continuous communication with a source of oil such as the crank case 54 of the four cycle engine 14 seen in FIG. 1 through a line 56. A check valve 57 is provided at the outlet end of the fuel supply line 56 which opens on the intake stroke to admit oil and closes on the output stroke of the piston 50. Also, the actuator 36 is provided with a return line 58 to return excess oil to the crank case 54. A pressure relieve valve 60 is provided at the inlet end of the return line 58 to prevent oil pressure from actuator 36 exceeding some predetermined pressure, for example 50 psi.

The piston 50 of the hydraulic actuator 36 is moved against the action of a spring 62 by contact with one of the rotating valve cams 64. The cam 64 for a single cylinder engine can be one of the valve cams in order to provide one fuel injection for each combustion cycle of the four stroke engine. If the engine has two cylinders, a special double cam can be used on the cam shaft to give fuel injection twice in the four stroke cycle. If desired the drive cam 64 for reciprocating the hydraulic actuator 36 could be formed on the drive shaft of the engine with the actuator 36 in close proximity to the crank case oil.

Reciprocation of the drive cam 64 causes reciprocation of the actuator piston 50 with the spring 62 acting to maintain the piston 50 in constant contact with the cam 64. When the spring 62 is moving the actuator piston 50, oil is drawn into the cylinder 52 through the oil supply line 56. On the return stroke of the piston 50 to compress the spring 62, oil is ejected through the line 34 placing the actuator 36 in communication with the fuel pump 20. The pulses of oil supplied through the lines 34 to the pump 20 serve to deliver pulses of fuel from the pump 20 in timed relationship to the reciprocation of the engine.

From this it will be seen that the position of the throttle valve 42 determines the position of the calibrated or programmable cam 40 determining the length of stroke of the fuel pump cylinder 30 so that metered amounts of fuel are delivered through the injection nozzle 16 to the mixing passage 17. The position of the pump piston 30 is at a maximum stroke when the butterfly valve 42 is in its fully open position as shown in broken line in FIG. 1 and is at a minimum when the butterfly valve 42 is in its almost closed position.

The position of the butterfly valve 42 is responsive to the speed and load conditions of the engine 14 and that position is transmitted to the metering cam 40 associated with the fuel pump 20 so that metered pulses of fuel are injected into the mixing passage 17 in the four cycle engine 14. Since the cam 40 determines the output of the fuel pump 20, the cam 40 can be adjusted relative to its shaft on which it is mounted to rotate it slightly to change the effectiveness of the cam 40 particularly for high altitude operation. Such an adjustment typically would not be available to anyone except professional mechanics.

A feature of the fuel injection system is that the line 34 between the actuator 36 and pump 20 is continuously filled with oil which lubricates the pump 20.

A feature also that can be incorporated in the mixing passage 17 of Venturi member 18 is a throw back or groove ring 68 which is best seen in FIG. 2 and disposed at an angle to the axis of the mixing passage 17. The ring 68 is disposed downstream of nozzle 16 and acts to spin the air and fuel mixture and causes any fuel that may tend to migrate towards the inlet 18*a* of the Venturi member 18 to be returned toward the combustion chamber of the engine. This helps to prevent unburned fuel from being released into the atmosphere on small engines.

In operation, the four cycle engine 14 is started with a conventional choke valve (not shown) temporarily closed and the throttle or butterfly valve 42 in about a one-third open position. After starting, the choke valve closes and movement of the throttle valve 42 to various positions results in changes in speed. When the throttle valve 42 is moved toward its closed position, the volume of fuel injected is small and when the throttle valve 42 is moved towards its open position, the amount of fuel injected is substantially larger. This occurs because movement of the throttle valve 42 correspondingly moves the cam 40 to determine the stroke of the fuel pump and therefore its output. As a consequence, throttle valve 42 in its almost closed position, results in a low idle speed of the engine and movement of the throttle valve 42 to a more fully open position results in maximum output of the pump and fast response to obtain high speed of the engine.

The calibrated cam 40 results in the ideal mixture of fuel and air for the particular condition in arranging from idle to fill speed including loads of varying conditions.

A fuel metering and supply system has been provided in which predetermined increments of fuel are delivered to the combustion chamber of an engine through an arrangement using a variable displacement pump. The displacement of the pump is determined by the position of the metering cam that responds to the position of the throttle or butterfly valve in an air fuel supply system. The butterfly valve position can be moved or controlled in response to an engine governor or can be moved manually. By metering the fuel in response to speed and load demands of an engine the appropriate amount of fuel is delivered to the combustion chamber to minimize fuel usage and waste. The system is designed for one or two cylinder engines but could be modified for additional cylinders. Also, the design disclosed is for four cycle engines but with some variation, such as injection of air and fuel directed to the combustion chamber, the system could be used for two cycle engines.

The fuel supply system of the present invention is economical to produce and to operate. It affords flexibility for the mounting of the actuator 36 and throttle control body. The system is designed to perform in all positions and the effects of sudden movement or vibration are minimized. The system also is adapted for engines in vehicles operating on hills and in boats where varying positions are encountered as well as in more stable positions such as for generators.

What is claimed is:

1. A fuel supply system for a reciprocating engine, combination comprising:

a fuel injector for receiving fuel from a source of fuel and delivering fuel to an engine cylinder;

a variable volume, positive displacement fuel pump having an inlet for receiving fuel from said source of fuel and an outlet for delivering fuel to said injector, said pump including a reciprocating piston means and a pivoting cam to engage said piston means to regulate the length of stroke of said piston means;

a throttle valve rotatable to control the volume of air to said engine cylinder and having positions proportional to speed and load on said engine; and control means including a mechanical connection between said cam and said throttle valve for movement of said cam in response to movement of said throttle valve to control the displacement of said pump to said fuel injector for each intake stroke of said engine in proportion to speed and load on said engine.

2. The fuel supply system of claim 1 wherein said mechanical connection is a link.

3. The fuel supply system of claim 2 wherein said mechanical link is provided with a resilient member to dampen vibrations and minor movements of said throttle valve.

4. A fuel supply system of claim 1 wherein the stroke of said piston means of said pump is at a maximum stroke when said engine is operating at maximum speed and at a minimum stroke when said engine is operating at minimum speed.

5. A fuel supply system for a reciprocating engine, the combination comprising:

a fuel reservoir;

a mixing chamber for receiving air and fuel;

a nozzle positioned to deliver fuel to said mixing chamber;

a pump having a piston reciprocating in response to hydraulic pressure, said pump having an inlet for receiving fuel from said reservoir and an outlet for delivering fuel to said nozzle;

a hydraulic actuator moveable in timed relationship to the reciprocation of said engine;

conduit means connecting said pump and hydraulic actuator, said pump being operable to deliver hydraulic fluid to said pump to reciprocate said piston;

a programmable cam engageable with said piston to regulate the length of its reciprocating stroke between a minimum stroke and a maximum stroke;

a throttle valve in said mixing chamber to said engine moveable to control the amount of air and fuel delivered from said mixing chamber; and linkage means connected to said throttle and to said cam for moving said cam in response to movement of said throttle to vary the stroke of said piston and displacement of said pump in proportion to the engine speed and load.

6. The fuel supply system of claim 5 wherein said cam is a pivoting cam engageable with one end of said piston to limit its stroke.

7. The fuel supply system of claim 5 wherein the position of said programmable cam is in response to the position of said throttle to determine the displacement of said pump between its minimum and maximum strokes.

8. The fuel supply system of claim 5 wherein said programmable cam is shaped to determine the positions of the piston and output of said pump high and low speeds of said engine.

9. The fuel supply system of claim 5 wherein said linkage means is provided with a resilient member between said throttle and said valve to absorb dampen vibrations.

10. The fuel supply system of claim 6 wherein said programmable cam is mounted on a shaft and said cam is adjustable relative to said shaft to accommodate different activities of the environment in which the engine operates.

11. The fuel supply system of claim 5 wherein the actuator is reciprocated in response to a valve cam of said engine.

12. The fuel supply system of claim 5 wherein said mixing chamber has an axial air passage and forms an annular groove disposed at an angle to the axis of said passage for spinning the air and fuel moving in said passage to maintain fuel movement in one direction in said passage.

* * * * *